US009291419B2

(12) United States Patent
Shipman

(10) Patent No.: US 9,291,419 B2
(45) Date of Patent: Mar. 22, 2016

(54) CLEANING PATCH GRIP AND SYSTEM

(75) Inventor: Kel Shipman, Rochester, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 1095 days.

(21) Appl. No.: 13/351,366

(22) Filed: Jan. 17, 2012

(65) Prior Publication Data

US 2012/0180816 A1 Jul. 19, 2012

Related U.S. Application Data

(60) Provisional application No. 61/433,256, filed on Jan. 16, 2011.

(51) Int. Cl.
*F41A 29/02* (2006.01)
*B08B 9/043* (2006.01)

(52) U.S. Cl.
CPC ..... *F41A 29/02* (2013.01); *B08B 9/0436* (2013.01)

(58) Field of Classification Search
CPC ..... F41A 29/00; F41A 29/02; B08B 9/0436
USPC ..... 42/95; 15/104.165, 104.17, 104.18, 15/104.19, 104.2, 104.062, 104.063, 15/104.066, 104.067, 104.068, 104.069
See application file for complete search history.

(56) References Cited

U.S. PATENT DOCUMENTS

| | | | | | |
|---|---|---|---|---|---|
| 1,927,747 | A | * | 9/1933 | Justice | 15/197 |
| 3,915,326 | A | * | 10/1975 | Hrubesky | 215/219 |
| 4,873,778 | A | * | 10/1989 | Stipp | 42/95 |
| 5,249,760 | A | | 10/1993 | Morimoto | |
| 6,145,235 | A | * | 11/2000 | Emerson et al. | 42/90 |
| 7,356,961 | B2 | * | 4/2008 | Williams | 42/95 |
| D684,660 | S | * | 6/2013 | Rogers et al. | D22/199 |
| 2005/0229467 | A1 | | 10/2005 | Sohn | |
| 2012/0102667 | A1 | * | 5/2012 | Higgins et al. | 15/104.16 |

OTHER PUBLICATIONS

International Searching Authority International Search Report and Written Opinion for PCT/US2012/021337 dated Apr. 25, 2012 (10 pgs).

* cited by examiner

*Primary Examiner* — Stephen M Johnson
(74) *Attorney, Agent, or Firm* — Harris Beach PLLC

(57) ABSTRACT

A novel cleaning patch system comprising a novel patch grip for cleaning firearm barrels is disclosed. A patch grip includes an arbor and a plug. The arbor includes a base, a stem extending from the base, and an elongate crest connected to the stem. The plug includes an elongate passage therethrough that generally matches the dimensions of the elongate crest. The plug further comprises relatively recessed and/or protruding structures on the face of the plug adjacent the elongate passage that engage the crest of the arbor and prevent inadvertent rotation of the plug on the arbor during firearm cleaning.

13 Claims, 5 Drawing Sheets

CLEANING PATCH GRIP AND SYSTEM

CROSS REFERENCE TO RELATED APPLICATION

Reference is made to and this application claims priority from and the benefit of U.S. Provisional Application Ser. No. 61/433,256, filed on Jan. 16, 2011, entitled "CLEANING PATCH GRIP AND SYSTEM", which application is incorporated herein in its entirety by reference.

FIELD OF THE INVENTION

The present disclosure relates generally to a cleaning patch grip and cleaning patch system for cleaning a firearm barrel interior.

BACKGROUND

Carbon, soot, and other residue from gunpowder and from firearm discharge reactions accumulate on firearm components such as the firing chamber and interior of the barrel over time. Depending on usage, a firearm barrel may also accumulate dust, dirt, mud, sand, snow, and other debris. All of these contaminants pose deleterious effects on cleanliness, performance, and longevity of the firearm barrel interior. A firearm barrel interior therefore requires regular cleaning and lubrication to prevent such debris interfering with firearm performance or causing corrosion or other degradation of the barrel and other firearm components. However, many forms of debris are tenacious and difficult to remove even with typical cleaning methods.

A number of devices have been introduced for improved cleaning of the interior of firearm barrels. For example, a firearm barrel cleaner may have a flexible cable or rigid rod that may be pulled or pushed through the barrel, carrying implements for brushing or scraping, or retaining a cleaning patch, sometimes using different implements for dislodging debris and then clearing the debris from the barrel. However, numerous persistent challenges have remained in providing a capability for cleaning the interior of a firearm barrel effectively and rapidly. This may be a particularly compelling need in challenging environments of field use, such as military, law enforcement, and remote or extended hunting activities. A sudden need may arise to clean the barrel interior in a remote setting, and do so rapidly to have the firearm back in operable order quickly.

The discussion above is merely provided for general background information and is not intended to be used as an aid in determining the scope of the claimed subject matter.

SUMMARY

A novel cleaning patch system comprising a novel patch grip for cleaning firearm barrels is disclosed. A patch grip includes an arbor and a plug. The arbor includes a base, a stem extending from the base, and an elongate crest connected to the stem. The plug includes an elongate passage therethrough that generally matches the dimensions of the elongate crest. The plug further comprises relatively recessed and/or protruding structures on a face of the plug adjacent the elongate passage that laterally engage with the crest of the arbor to resist inadvertent rotation of the plug on the arbor during cleaning processes. The patch grip may be used to securely grip a cleaning patch between the arbor and the plug, which may be put together in a very rapid and convenient manner well-suited for field use. The patch grip can be secured to a flexible cable or a rigid rod for drawing through a firearm barrel, to clean the interior of the firearm barrel.

This Summary is intended only to provide a brief overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

For a further understanding of the objects of the various illustrative embodiments, reference will be made to the following detailed description which is to be read in connection with the accompanying drawings.

The drawings are not necessarily to scale, emphasis instead generally being placed upon illustrating the principles of various embodiments. In the drawings, like numerals are used to indicate like parts throughout the various views.

DETAILED DESCRIPTION OF ILLUSTRATIVE EMBODIMENTS

Figure 1:
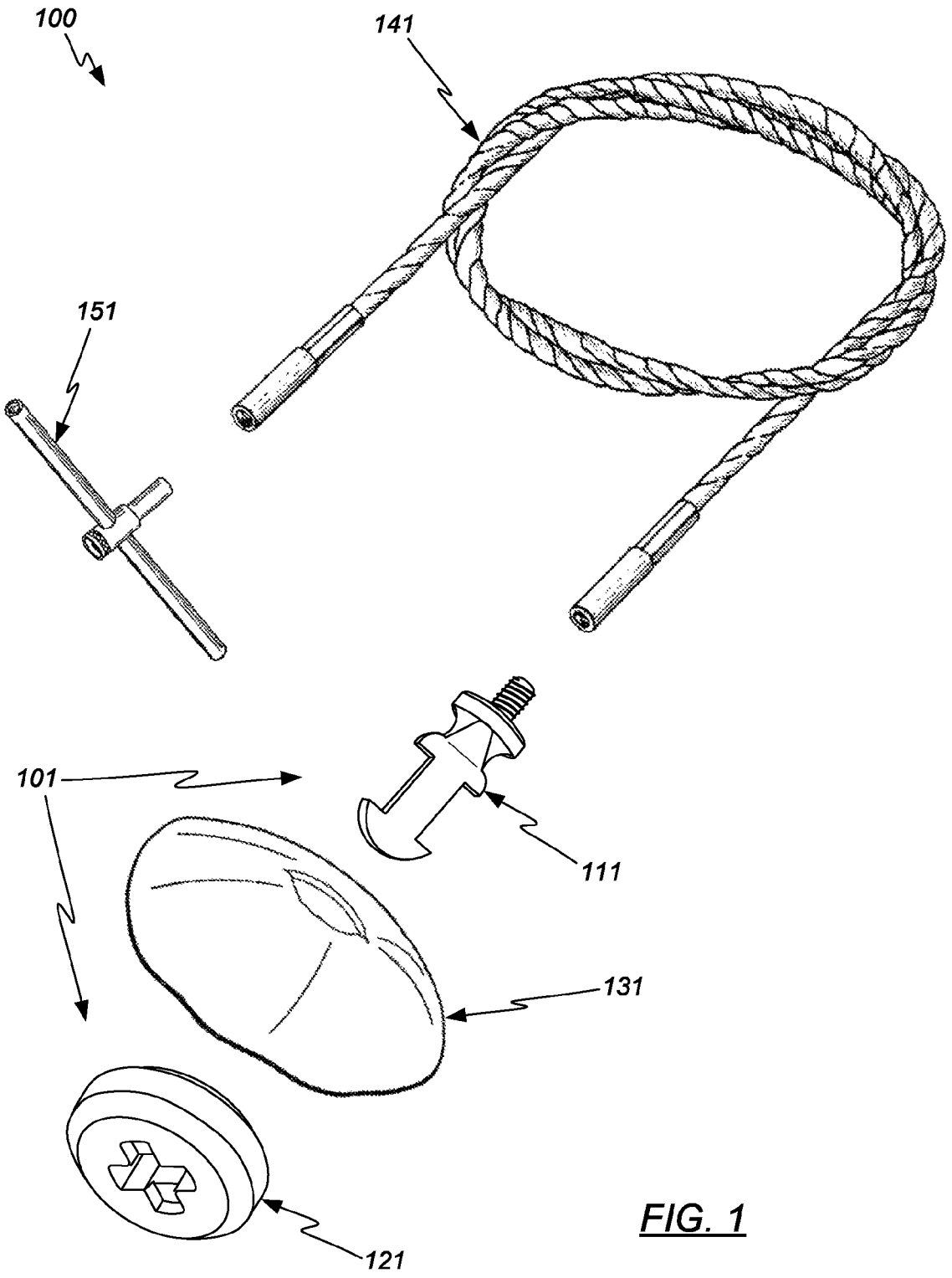
FIG. 1 depicts a perspective view of a cleaning patch system including a patch grip, a patch, a flexible cable, and a handle, wherein the patch grip includes an arbor and a plug, in accordance with an illustrative embodiment.

FIG. 1 depicts a perspective view of a cleaning patch system 100 that includes a patch grip 101, a patch 131, a flexible cable 141, and a handle 151, wherein the patch grip 101 includes an arbor 111 and a plug 121, in accordance with an illustrative embodiment. Cleaning patch system 100 may be used for cleaning the interior of a firearm barrel, for example. Cleaning patch system 100 may be stored within a single container for packaging and sale as a kit and for storage and transport by the user. Cleaning patch system 100 enables cleaning a barrel interior in a fast and effective way, including in field usage. The arbor of the patch grip can include a connector for attaching one of a rod and a flexible cable thereto. The connector can be a threaded connector (e.g. FIG. 4, threaded stem 115). For example, handle 151 and arbor 111 may be screwed into flexible cable 141 with threaded screw connections, and left in this attached arrangement in a kit for transport in the field.

Figure 2:
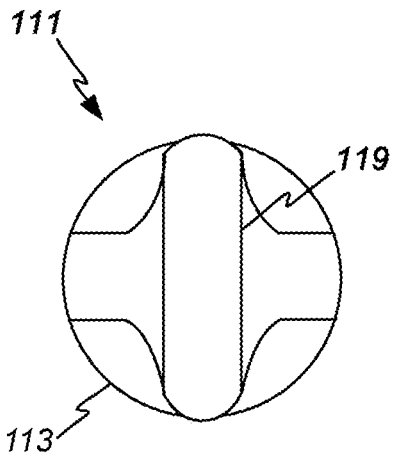
FIG. 2 depicts a top plan view of an arbor for a patch grip.
Figure 3:
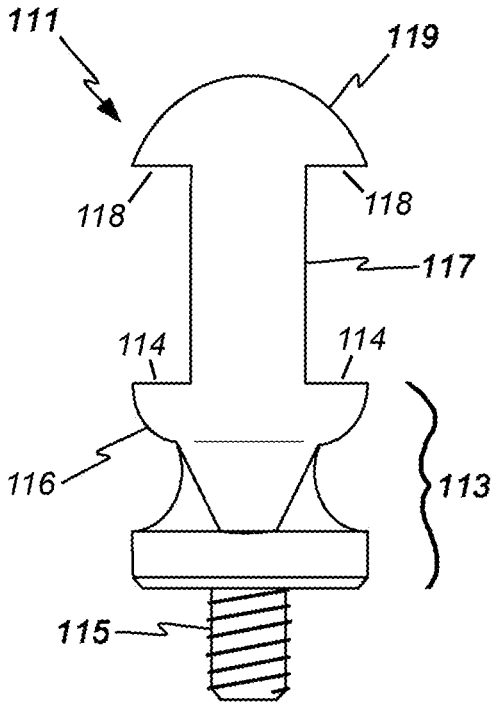
FIG. 3 depicts a front plan view of an arbor for a patch grip.
Figure 4:
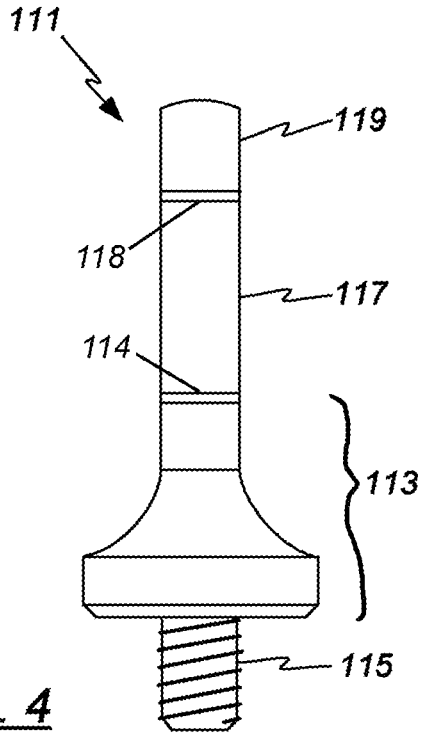
FIG. 4 depicts a side plan view of an arbor for a patch grip.

A method of using the patch system 100 is explained below, after the features of the arbor 111 and plug 121 are depicted and described, as follows. FIG. 2 depicts a top plan view of the arbor 111; FIG. 3 depicts a front plan view of the arbor 111; and FIG. 4 depicts a side plan view of the arbor 111. Referring to all three of these figures, arbor 111 includes a base 113 with a base wing 116 with base wing flats 114; a threaded stem 115 extending below the base 113; a stem 117 extending upward from the base 113; and a winged elongate crest 119 with winged elongate crest flats 118, topping the stem 117. Threaded stem 115 may allow a threaded connection to a threaded bore on an end of flexible cable 141. In other embodiments, an arbor may have a threaded bore and attach to a threaded stem of a cable, for example. Base 113 has sculpted features to facilitate ease of handling, and may be knurled, textured, or include other features for ease of handling in various embodiments.

Figure 5:
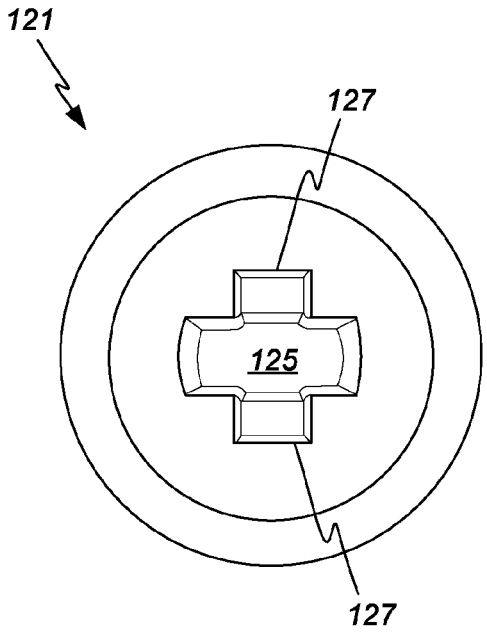
FIG. 5 depicts a top plan view of a first embodiment of a plug for a patch grip.
Figure 6:
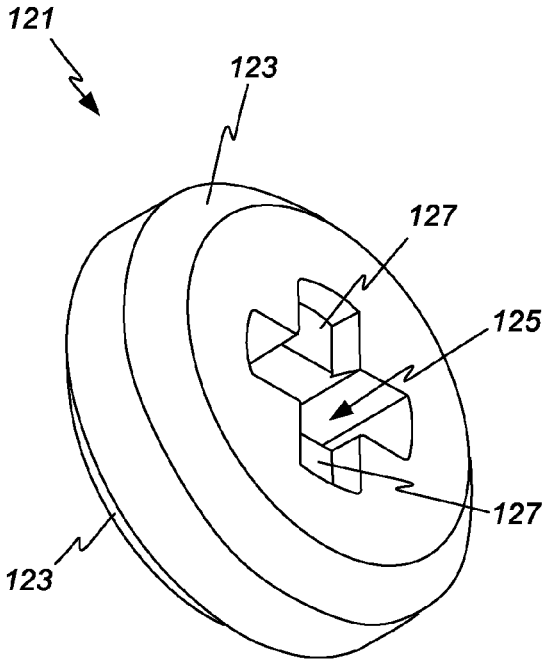
FIG. 6 depicts a perspective view of a first embodiment of a plug for a patch grip.
Figure 7:
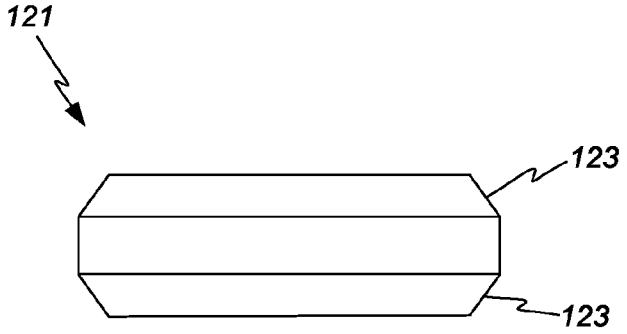
FIG. 7 depicts a side plan view of a first embodiment of a plug for a patch grip.

FIG. 5 depicts a top plan view of one embodiment of the plug 121; FIG. 6 depicts a perspective view of the plug 121; and FIG. 7 depicts a side plan view of the plug 121. Plug 121 may include opposing chamfers 123 around its rim. Plug 121 also includes an elongate passage 125 extending through its center, elongated in one dimension (length) relative to the transverse dimension (width). Plug 121 may further include opposing recesses or cavities 127 or raised protrusions formed to the sides of elongate passage 125 on at least one face of the plug 121. Elongate passage 125 is dimensioned to allow the winged elongate crest 119 of the arbor 111, so that the winged elongate crest 119 can pass through the elongate passage 125 in one orientation, but then be rotated to a different orientation in which the elongate dimension of the winged elongate crest 119 is out of alignment with the elongate dimension of the passage 125, and the winged elongate crest 119 is blocked by the face of the plug 121, and/or by the transverse cavities 127 or protrusions adjacent to the passage 125.

The patch 131 may be held in contact against one of the chamfers 123 along with the rim of plug 121, which may help maintain alignment of the plug 131 within the barrel, thus reducing the possibility of the patch grip 101 becoming stuck within the barrel. The chamfer 123 may also help maintain contact between the patch 131 and the plug 121 as well as between the patch 131 and the barrel interior during the cleaning process. In another embodiment, a plug may be used that is identical except that it lacks cavities 127, and the wings of the winged elongate crest 119 of arbor 111 may rest against the face of the plug 121, for example.

When a user needs to clean a barrel interior, the user may access the patch 131 and the combined flexible cable 141 with handle 151 and arbor 111 already attached; slip the arbor through the opening in the patch 131; slip the winged elongate crest 119 of the arbor 111 through the elongate passage 125 through plug 121, so that the plug 121 rests on the stem 117 of the arbor 111; then rotate the plug 121 by 90 degrees around the stem 117, and pull the plug 121 back a short space against the winged elongate crest 119 of arbor 111, so that the wings of the winged elongate crest 119 settle into the opposing cavities 127 positioned in the plug 121 to the sides of the elongate passage 125. The plug 121 then rests securely positioned relative to arbor 111, such that the patch 131 is also held around the plug 121 between the plug 121 and the base 113 of the arbor 111.

Figure 8:
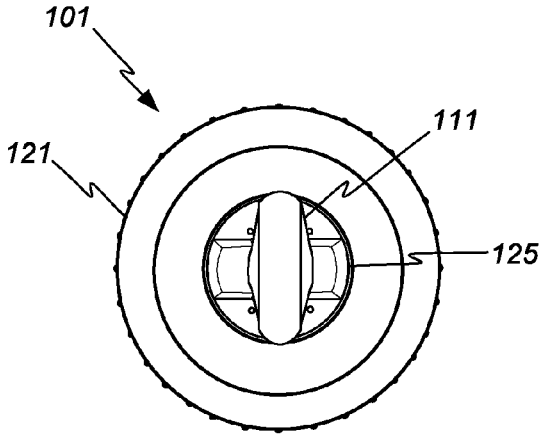
FIG. 8 depicts a top plan view of a patch grip comprising an arbor and a plug.
Figure 9:
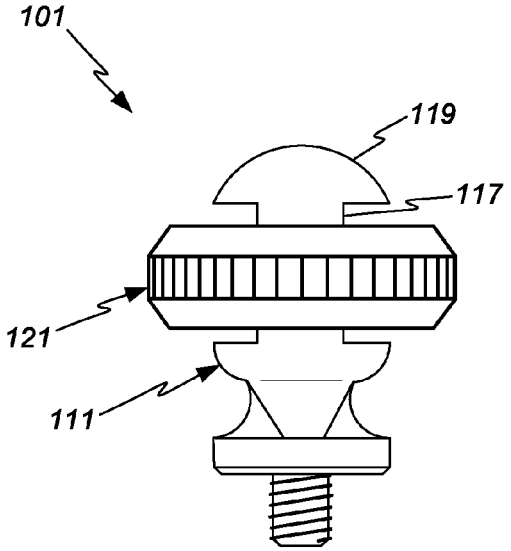
FIG. 9 depicts a front plan view of a patch grip comprising an arbor and a plug.
Figure 10:
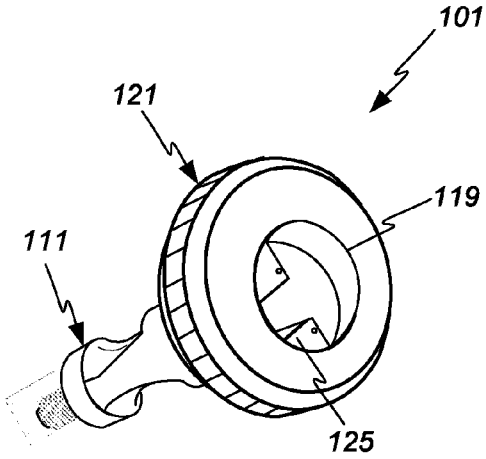
FIG. 10 depicts a perspective view of a patch grip comprising an arbor and a plug.
Figure 11:
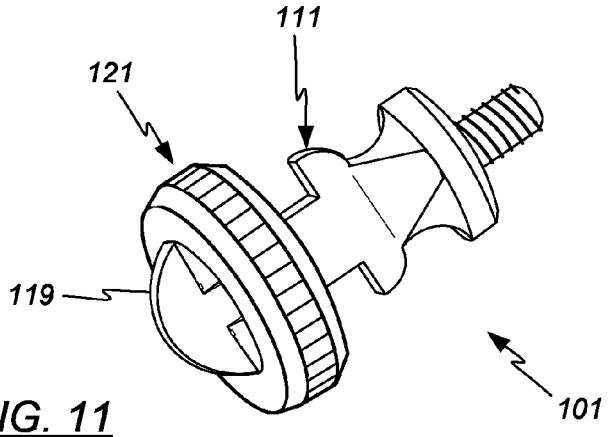
FIG. 11 depicts a different perspective view of a patch grip comprising an arbor and a plug.

FIGS. 8 through 11 depict just the arbor 111 and plug 121 that together form the patch grip 101, in or close to this securely positioned state. FIG. 8 depicts a top plan view of patch grip 101, with arbor 111 rotated 90 degrees from its entry position; FIG. 9 depicts a front plan view of patch grip 101, with the winged elongate crest 119 of arbor 111 positioned around the stem 117 of arbor 111 but not yet nestled into the cavities 127 of the plug 121; FIG. 10 depicts a perspective view of patch grip 101 with the winged elongate crest 119 of arbor 111 pulled into the cavities 127 of the plug 121; and FIG. 11 depicts a different perspective view of patch grip 101 with the winged elongate crest 119 of arbor 111 pulled into the cavities 127 of the plug 121.

Figure 12:
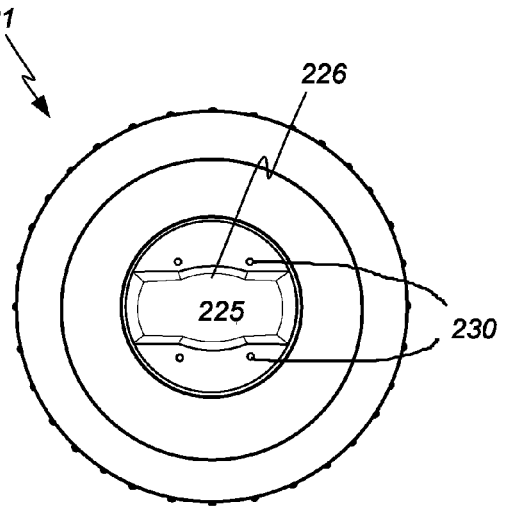
FIG. 12 depicts a top plan view of an alternative embodiment of a plug for a patch grip.
Figure 13:
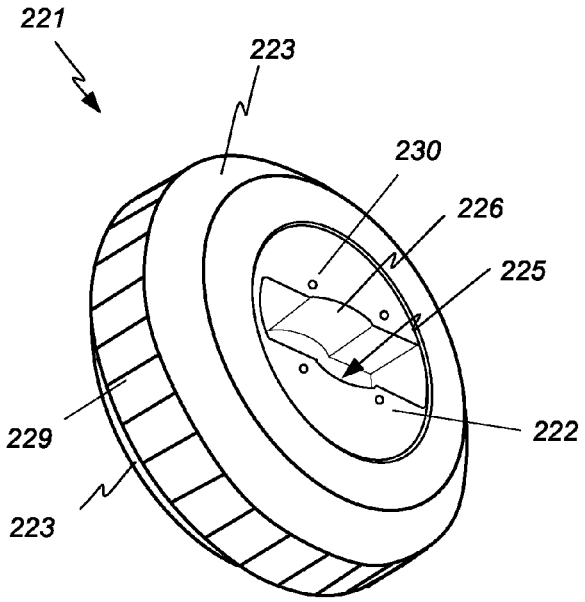
FIG. 13 depicts a perspective view of an alternative embodiment of a plug for a patch grip.
Figure 14:
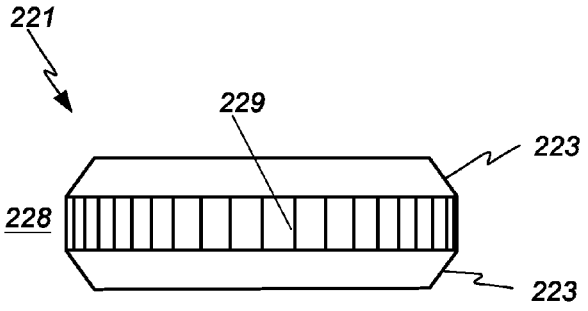
FIG. 14 depicts a side plan view of an alternative embodiment of a plug for a patch grip.

FIGS. 12 through 14 depict views of an alternative embodiment of a plug 221. FIG. 12 depicts a top plan view of the plug 221; FIG. 13 depicts a perspective view of the plug 221; and FIG. 14 depicts a side plan view of the plug 221. Plug 221 includes opposing chamfers 223 around its rim 228. The rim 228 of the plug may be textured to assist in gripping and rotating the plug, particularly when the plug may be at least partially covered with cleaning solvent or lubricants. FIGS. 13 and 14 depict the texturing as a series of longitudinal ridges 229. However, the texturing may also include at least one circumferential or helical ridge, longitudinal, circumferential or helical slit, protrusions, knurling, a roughened surface or other operable structure sufficient to allow a user to grip and manipulate the plug. Plug 221 also includes an elongate passage 225 extending through its center, elongated in one dimension relative (length) to the transverse dimension (width). The elongate passage 225 is dimensioned to allow the winged elongate crest 119 of the arbor to be inserted through the passage. The elongate passage may also have a central cylindrical portion 226 that is slightly wider than the width of the passage. The cylindrical portion 226 of the passage is dimensioned to allow the stem 117 of the arbor to rotate at least 90 degrees after the insertion of the winged elongate crest 119 through the elongate passage 225.

Plug 221 further includes opposing faces 222. At least one face may have recessed and/or protruding structures adjacent to the elongated passage 225. FIGS. 12 and 13 depict a series of protruding bumps 230 on the face of the plug. While shown as protruding bumps, the structures may be continuous or discontinuous ridges or recessed cavities 127 as depicted as in FIGS. 5 and 6. The recessed and/or protruding structures merely need to provide a modest level of lateral support of the wings of the winged elongate crest 119 such that the plug and arbor do not rotate to align the elongated dimension of the crest with the elongate passage 225 through the plug. Allowing the crest to align with the passage has the potential to allow the plug and arbor to inadvertently separate as the patch grip is being pulled or pushed through the barrel during cleaning operations. In the alternative embodiment of the plug 221, the protruding bumps 230 may be disposed on each opposing face of the plug such that the plug is symmetric in radial cross-section and is operable irrespective of which face of the plug positioned nearer the base 113 or the winged elongate crest 119 of the arbor 111

The patch system 100 is then ready to pull the patch 131 through a firearm barrel (not depicted here). The handle 151 may be of a collapsible type that can be dropped through a gun barrel while attached to flexible cable 141, or may be secured to flexible cable 141 after the cable is dropped through the firearm barrel. The handle 151 may be passed through the barrel from the breech to the muzzle; then the user may take hold of the handle and use it to pull the patch grip 101 holding the patch 131 through the barrel from the breech to the muzzle. That is, the flexible cable 141 may, for example, be introduced through the chamber of the firearm (not shown), and advanced through the firearm in a breech-to-muzzle direction, i.e. through the chamber, shoulder, neck and barrel, until the handle 151 or the handle end of the flexible cable 141 emerges from the firing end of the firearm. The handle 151 may then be gripped and used to pull the patch grip 101 with attached patch 131 in a breech-to-muzzle direction, with the plug 121 keeping the patch 131 pressed against the entire diameter of the barrel interior as it is drawn through the barrel. The plug 121 may be sized for a particular firearm caliber or barrel diameter or range of similar calibers, such as 45 caliber, 10-12 gauge, 16-20 gauge, or 40 mm, for example, such that the plug 121 presses the patch 131 reliably against the entire diameter of the barrel interior as it passes through, thereby ensuring an effective cleaning of the barrel interior.

The plug 121 and arbor 111 therefore provide a way to have the patch 131 securely gripped with a very fast and simple motion, that does not require the patch to be folded and threaded through an eyelet, and does not require any components to be screwed together. These advantages may be particularly valuable in field usage, in which the user may be wearing gloves, may be in a disruptive environment, and may have very little time to be able to devote to cleaning the barrel interior.

The patch system 100 including patch grip 101 may be used in combination with other cleaning elements, bore solvent or lubricant (not depicted here), and other tools in various embodiments for achieving a complete cleaning of the interior of a firearm barrel. Bore solvent or other cleaning substance may be applied to patch 131 prior to patch grip 101 and patch 131 being drawn through the barrel interior. The bore solvent or other cleaning substance may be provided in a tube or other container contained in a kit together with the other elements of patch system 100 as depicted in FIG. 1. The cleaning substance may also be a polytetrafluoroethylene-based (PTFE-based) polymer that acts as a solvent, a lubricant and a rust inhibitor, in an illustrative example. To maximize the effectiveness of the cleaning substance, it should be applied onto the patch 131 within a very short time (such as within a few seconds) prior to drawing the patch grip 101 and patch 131 through the firearm barrel.

The arbor 111 may be made of any of various materials, including but not limited to metallic-based materials and alloys thereof. For example, the arbor may be made of brass, such as alloy 360 brass in an illustrative embodiment. The plug 121 may be made of a range of materials. For example, the plug 121 may be made of a resilient, durable, non-metallic material, which may reduce the possibility of the patch 131 becoming torn against the plug 121 during the cleaning process. For example, the plug 121 may be made from a rubber or plastic-based material.

While various embodiments have been particularly shown and described, it will be understood by those skilled in the art that various combinations of the disclosed elements or changes in detail may be made without departing from the scope of the claims. Other variations may also be made within the realm of different embodiments. Although the present invention has been described herein with reference to details of various illustrative embodiments, it is not intended that such details be regarded as limiting the scope of the invention; that is, the foregoing description of the present invention is merely illustrative, and it should be understood that variations and modifications can be effected without departing from the scope or spirit of the invention.

What is claimed is:

1. A patch grip for cleaning the interior of a barrel of a firearm comprising:
- an arbor, comprising:
  - a base;
  - a substantially flat stem extending from the base;
  - a winged elongate crest connected to the stem at an end of said stem opposite from said base, said winged elongate crest having at least one laterally extending wing;
- a cylindrical plug comprising an elongate passage;
- wherein the winged elongate crest of the arbor passes through said elongate passage; and
- wherein after passing through said elongate passage, said arbor is rotated such that said winged elongate crest locks into place in a pair of transverse cavities on a face of the plug adjacent to said elongated passage, or locks against one or more protrusions on a face of the plug adjacent to said elongated passage.

2. The patch grip of claim 1, wherein the plug further comprises a rim having a chamfer.

3. The patch grip of claim 1, wherein the plug further comprises a rim having a textured surface.

4. The patch grip of claim 3, wherein the textured surface comprises at least one of a protrusion, a recess, knurling and a roughened surface.

5. The patch grip of claim 3, wherein the textured surface comprises at least one protruding ridge.

6. The patch grip of claim 5, wherein the textured surface further comprises a plurality of longitudinal ridges.

7. The patch grip of claim 1, wherein the elongate passage includes a cylindrical portion adapted to allow the stem of the arbor to rotate within said cylindrical portion.

8. The patch grip of claim 1, wherein the arbor includes a connector for attaching one of a rod and a flexible cable thereto.

9. The patch grip of claim 8, wherein the connector is a threaded connector.

10. The patch grip of claim 1, further comprising an absorbent cloth patch.

11. A patch grip system for cleaning the interior of a barrel of a firearm comprising:
- an arbor, comprising:
  - a base;
  - a substantially flat stem extending from the base;
  - a winged elongate crest connected to the stem at an end of said stem opposite from said base, said winged crest having at least one laterally extending wing;
- a cylindrical plug comprising an elongate passage to pass the winged elongate crest of the arbor therethrough;
- a flexible cable having a first end attached to the base of the arbor and a second end attached to a handle.

12. The patch grip system of claim 11, wherein said handle comprises a folding T-handle having a first position in which T-handle is configured to pass through the barrel of the firearm.

13. The patch grip system of claim 11, further comprising a cloth patch disposed over the plug for absorbing loosened debris as the patch grip is passed through the barrel of a firearm.

* * * * *